US010413798B2

(12) United States Patent
Hill

(10) Patent No.: US 10,413,798 B2
(45) **Date of Patent: *Sep. 17, 2019**

(54) GOLF SWING TRAINING DEVICE

(71) Applicant: James Hill, Arlington Heights, IL (US)

(72) Inventor: James Hill, Arlington Heights, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/988,548

(22) Filed: May 24, 2018

(65) Prior Publication Data

US 2018/0280777 A1 Oct. 4, 2018

Related U.S. Application Data

(63) Continuation of application No. 15/483,168, filed on Apr. 10, 2017, now Pat. No. 9,999,822, which is a continuation of application No. 14/795,469, filed on Jul. 9, 2015, now Pat. No. 9,623,310.

(51) Int. Cl.
*A63B 69/36* (2006.01)
*A63B 69/00* (2006.01)

(52) U.S. Cl.
CPC ..... *A63B 69/36* (2013.01); *A63B 69/0057* (2013.01); *A63B 69/3641* (2013.01); *H05K 999/99* (2013.01); *A63B 2208/0204* (2013.01); *A63B 2210/50* (2013.01); *A63B 2225/09* (2013.01)

(58) Field of Classification Search
CPC . A63B 69/36; A63B 69/3623; A63B 69/3641; A63B 69/0057; A63B 2208/0204
See application file for complete search history.

(56) References Cited

U.S. PATENT DOCUMENTS 4,699,384 A * 10/1987 Bechler ..... A63B 69/3623 473/264
4,718,674 A * 1/1988 Henry ..... A63B 69/3623 473/218
4,993,716 A * 2/1991 Waller ..... A63B 69/3608 473/218
5,013,044 A * 5/1991 Hesselbart ..... A63B 69/3641 473/218
5,375,833 A * 12/1994 Marier, Jr. ..... A63B 69/3623 473/257

(Continued)

*Primary Examiner* — Raleigh W Chiu
(74) *Attorney, Agent, or Firm* — Vitale, Vickrey, Niro, Solon & Gasey LLP

(57) ABSTRACT

An easily assembled and disassembled portable golf swing training device includes plural interconnected elongated, linear rods and arms for the development of proper golf club takeaway, backswing and downswing mechanics. The position of the golf club during the swing is compared with generally accepted swing parameters, and club positions not within acceptable limits are evidenced by easily detected golf club contact with one or more of the device's arms which are all adjustable in length and position depending upon individual golfer characteristics, and which are pivotally mounted, padded and flexible to avoid injury as well as damage to the inventive device or to a golf club. The configuration of the various rods and arms is established to provide the golfer an inside-to-out club head path during the downswing to provide for a draw of the ball, or to shape the shot from right to left for a right hand golfer.

20 Claims, 4 Drawing Sheets

(56) References Cited

U.S. PATENT DOCUMENTS

| | | | | |
|---|---|---|---|---|
| 6,932,712 | B2 * | 8/2005 | Cardosi | A63B 69/3641 473/261 |
| 7,980,958 | B1 * | 7/2011 | Ford | A63B 69/3608 473/207 |
| 9,623,310 | B2 * | 4/2017 | Hill | A63B 69/0057 |
| 9,999,822 | B2 * | 6/2018 | Hill | A63B 69/0057 |
| 2005/0090324 | A1 * | 4/2005 | Cardosi | A63B 69/3641 473/257 |
| 2010/0120549 | A1 * | 5/2010 | Capesius | A63B 69/0057 473/257 |
| 2011/0294588 | A1 * | 12/2011 | Pies | A63B 69/3623 473/257 |
| 2012/0264533 | A1 * | 10/2012 | Sasser | A63B 69/3641 473/208 |
| 2013/0178302 | A1 * | 7/2013 | Shahi | A63B 69/3667 473/257 |
| 2015/0038248 | A1 * | 2/2015 | Deacon | A63B 69/3641 473/220 |

* cited by examiner

GOLF SWING TRAINING DEVICE

This application claims priority of prior application U.S. Ser. No. 15/483,168 filed Apr. 10, 2017 which claims priority of Ser. No. 14/795,469 filed Jul. 9, 2015, now U.S. Pat. No. 9,623,310.

This invention relates to apparatus for assisting a golfer in developing a proper golf swing, including golf club take-away, backswing and downswing.

BACKGROUND OF THE INVENTION

Prior golf training devices seek to impart to a golfer the proper mechanics, form and timing of the golf swing. Use of the proper techniques, increases the likelihood that the golfer will direct the ball in the desired direction and at the desired height, as well as over the intended distance. Past and present golf swing training devices have as their goal to teach and to instill in the golfer various characteristics of the desired golf club swing. For example, some devices such as that disclosed in U.S. Pat. No. 8,696,485 to Pies et al seek to teach the golfer the proper plane that the golf club should traverse in the vicinity of the golf ball using top and bottom flexible guides. Another approach is disclosed in U.S. Pat. No. 8,608,584 to Cobb which makes use of a mat positioned on the ground or a floor in supporting a golf ball and includes plural apertures disposed at predetermined locations in the mat in which pegs are inserted to define a desired swing path for right-handed or left-handed golfers. Also included is a T-shaped tube connector to which a pair of alignment rods are attached to align the golfer's feet with the intended direction of ball flight. Another instructional approach in this area is disclosed in U.S. Pat. No. 8,696,480 to Sasser which includes a tubular arrangement for positioning a golf ball, right and left lateral inner and outer guides which define the desired path of the head of the golf club in the area of the ball, and leg and hip brackets for controlling those portions of the golfer's body relative to the position of the teed-up ball. Yet another golf swing teaching approach is disclosed in U.S. Pat. No. 8,721,467 to Ackerman which trains both the back swing and the forward swing by providing physical barriers to golf club travel in limiting the path of the golf club to allegedly produce ideal ball flight. This golf swing trainer also provides an audible indicator to indicate that the back swing is too upright or too flat, and a visual indication of the proper club head path back to the ball in the down swing.

The golf swing training device of the present invention provides the golfer with a visual and tactile indication of the proper back swing and down swing for ensuring the proper club shaft back swing and down swing path, as well as the proper angle of the club head upon impact with the ball relative to the intended direction of ball flight to provide right to left trajectory, or drawing of the ball, during flight. The present invention goes further in improving golfer performance than the prior art by providing instant feedback to a golfer regarding golf swing characteristics of a more advanced nature than hitherto provided. More specifically, the present invention assists in the development of a one piece takeaway with maximum arc during the backswing. In addition, the present invention produces an inside-to-out club head swing path to produce drawing of the ball for increased shot accuracy and control. This last feature ensures that the club face is open (pointing to the right for a right-handed golfer) at ball impact so as to start the ball to the right which is the first part to hitting a draw, while the path of the club must go more to the right than the club face is pointing to impart the full draw effect on the ball.

OBJECTS AND SUMMARY OF THE INVENTION

Accordingly, it is an object of the present invention to assist a golfer in the development of generally recognized and accepted fundamentals of the optimum golf swing.

Another object of the present invention is to provide a training device for improving the swing of a golfer which provides immediate feedback to a user of proper or improper golf club motion, position and orientation prior to and upon impact with a golf ball, without complicated and expensive structure or electronics.

Still another object of the present invention is to provide a portable golf swing training device which is lightweight, easily assembled and disassembled, economical, and conveniently and easily utilized by golfers of virtually any skill level.

The present invention contemplates a portable apparatus comprised of plural linear, elongated rods and arms which provides a golfer with an indication of the proper golf club takeaway, backswing, downswing and impact with a golf ball. The apparatus includes a base positioned on the ground, or a mat, and having attached thereto an alignment rod and a first backswing arm also disposed on the ground and respectively aligned with the intended direction of ball flight and with an outer limit of the golf club during the backswing. Also attached to the base are a generally vertical rod and a downswing arm attached to an upper end portion of the vertical rod. The downswing arm extends downward in proceeding away from the vertical rod, or toward the golf ball, and is oriented at an angle on the order of 30° relative to the alignment rod. Attached to a second end portion of the base is a first backswing arm which is aligned generally with a portion of the golfer's optimum backswing. Attached to the distal, or forward, end of the first backswing arm is a second generally vertical rod, to an upper end of which is attached a generally horizontal second backswing arm having a distal end disposed in closely spaced relation to the distal end of the downwardly angled downswing arm. The golf club is moved in the backswing through the gap between the adjacent ends of the second backswing horizontal arm and the inclined downswing arm so that the club head passes above and travels along a portion of the length of the first backswing arm for maximum club takeaway arc. The transition between the backswing and downswing portions of the swing positions the club on the opposite side of the downswing arm from its aforementioned gap with the second backswing horizontal arm, providing the golfer with an in-to-out swing relative to the alignment rod so as to position and orient the club head upon impact with the ball to produce right-to-left flight, or a draw, of the golf ball for a right hand golfer, and the opposite directions of club displacement and ball flight for a left hand golfer.

BRIEF DESCRIPTION OF THE DRAWINGS

The appended claims set forth those novel features that characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
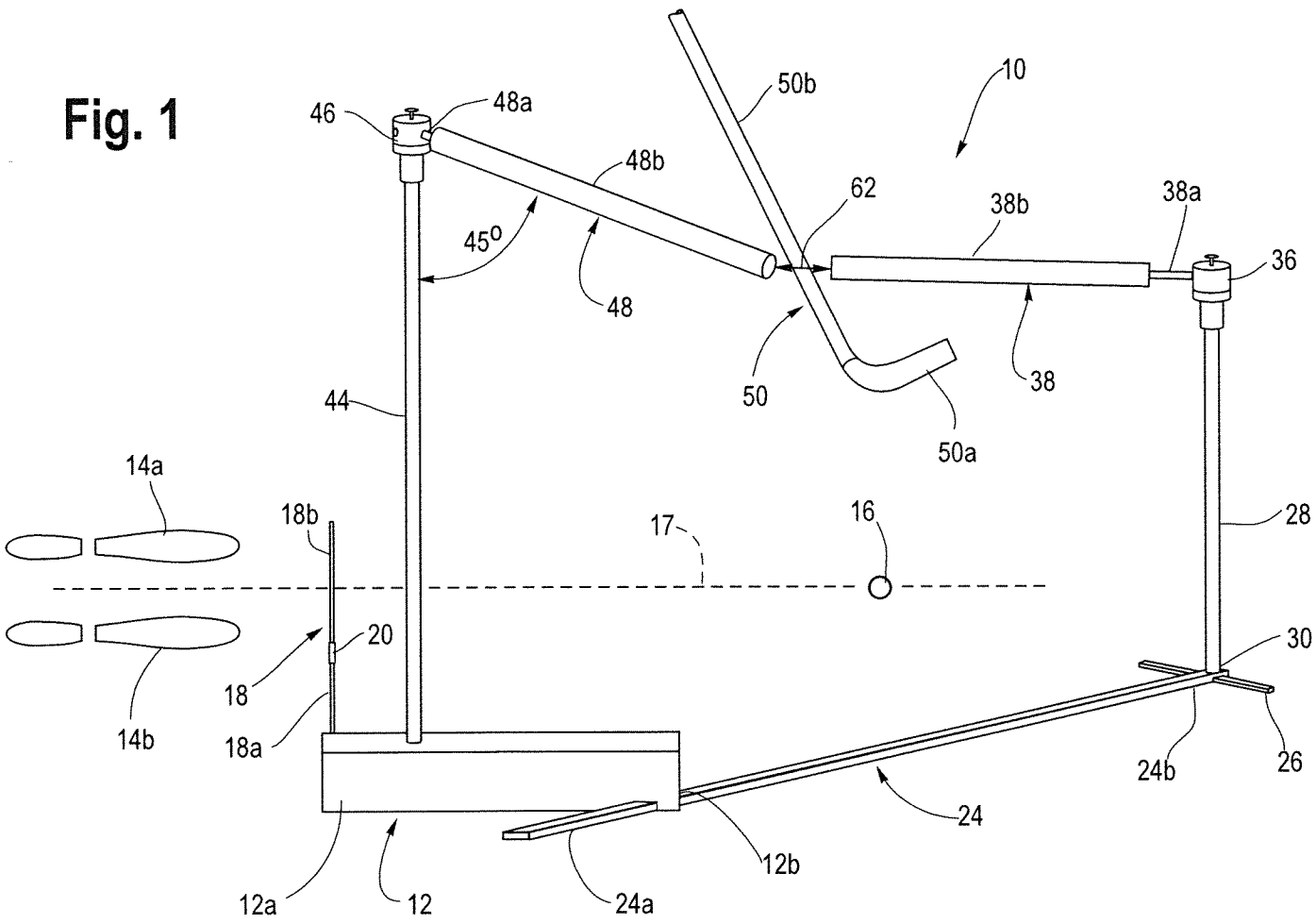
FIG. 1 is a perspective view of the golf swing training device of the present invention.
Figure 2:
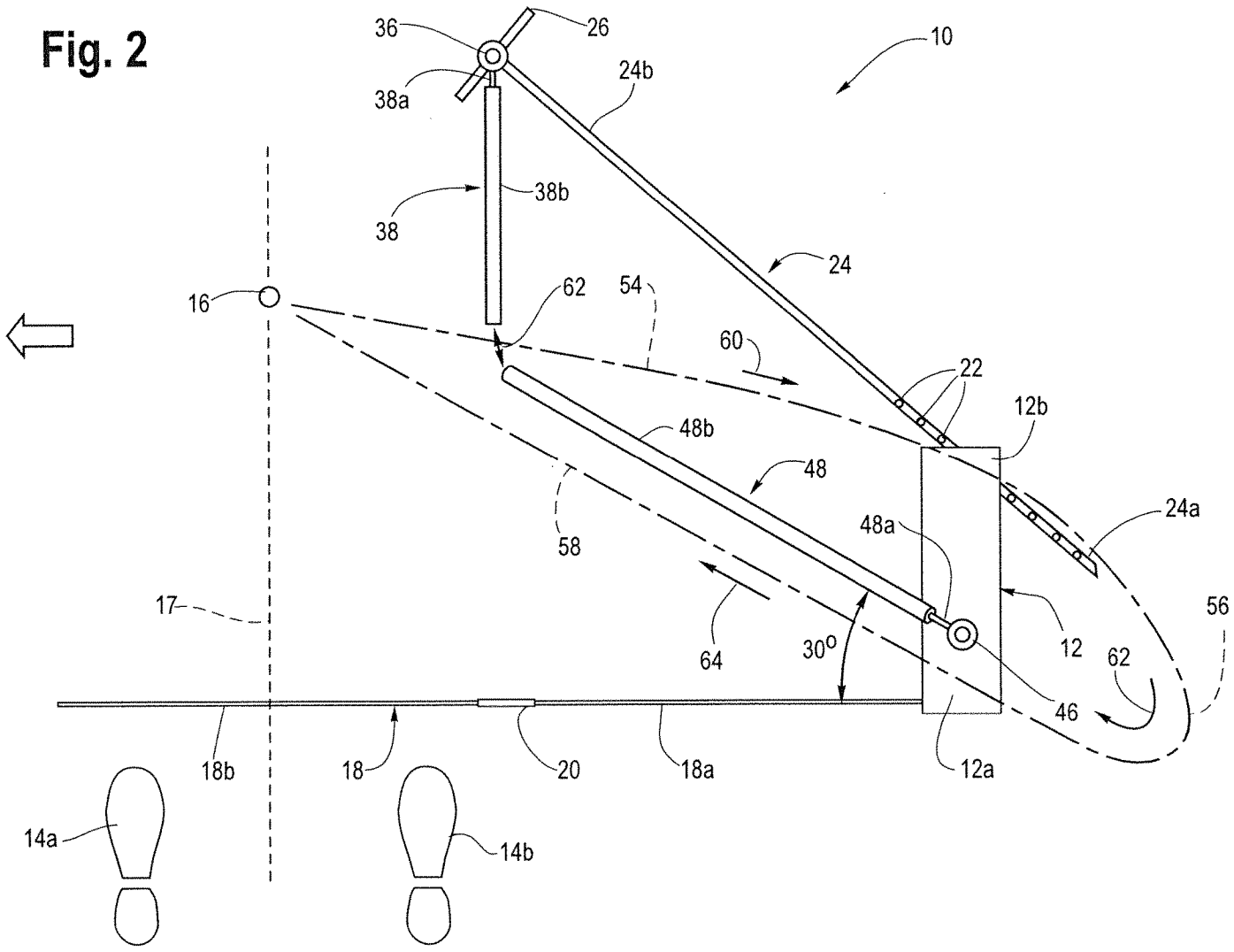
FIG. 2 is a top plan view of the golf swing training device of the present invention.
Figure 3:
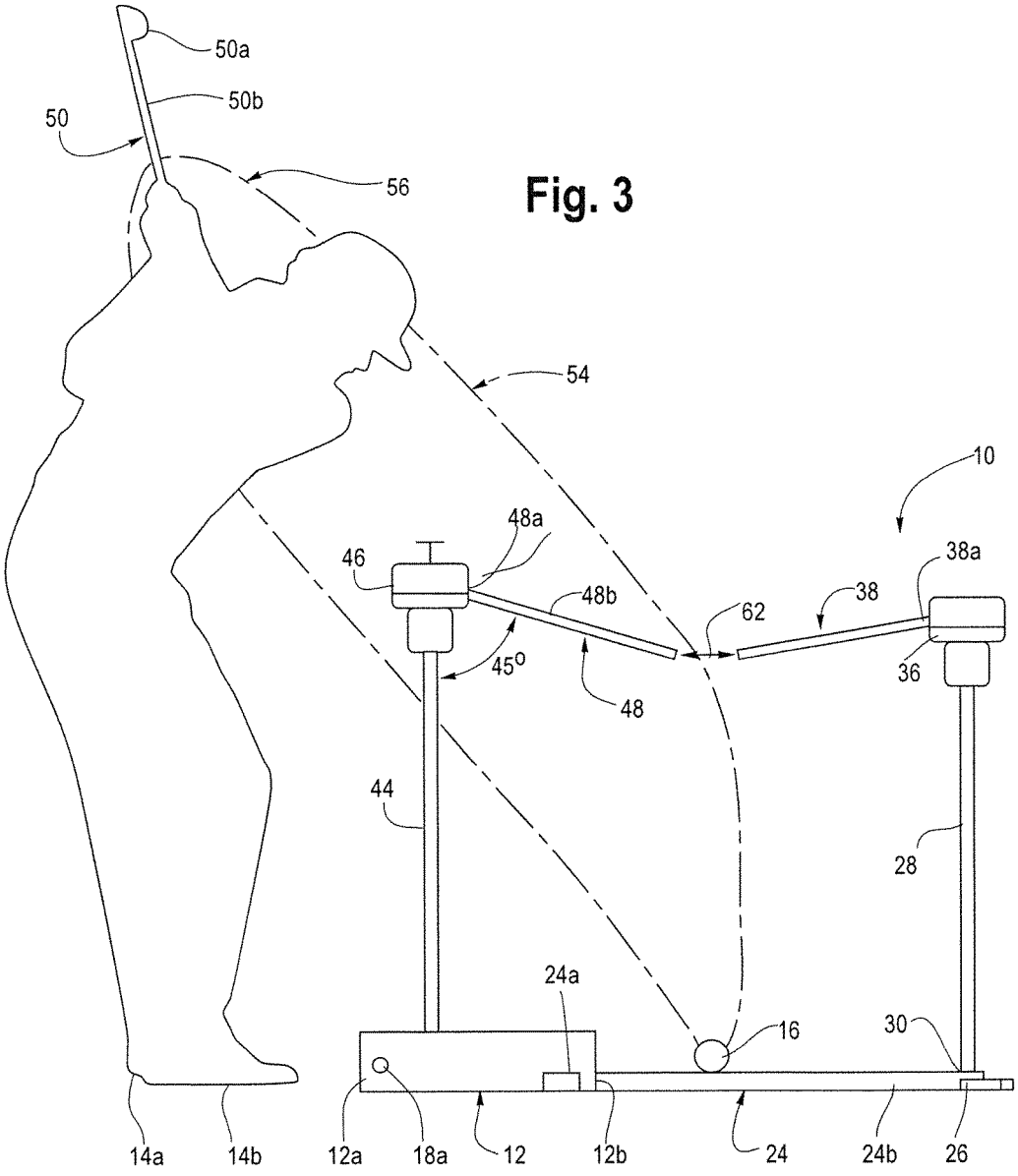
FIG. 3 is a side elevation view of the golf swing training device of the present invention.
Figure 4:
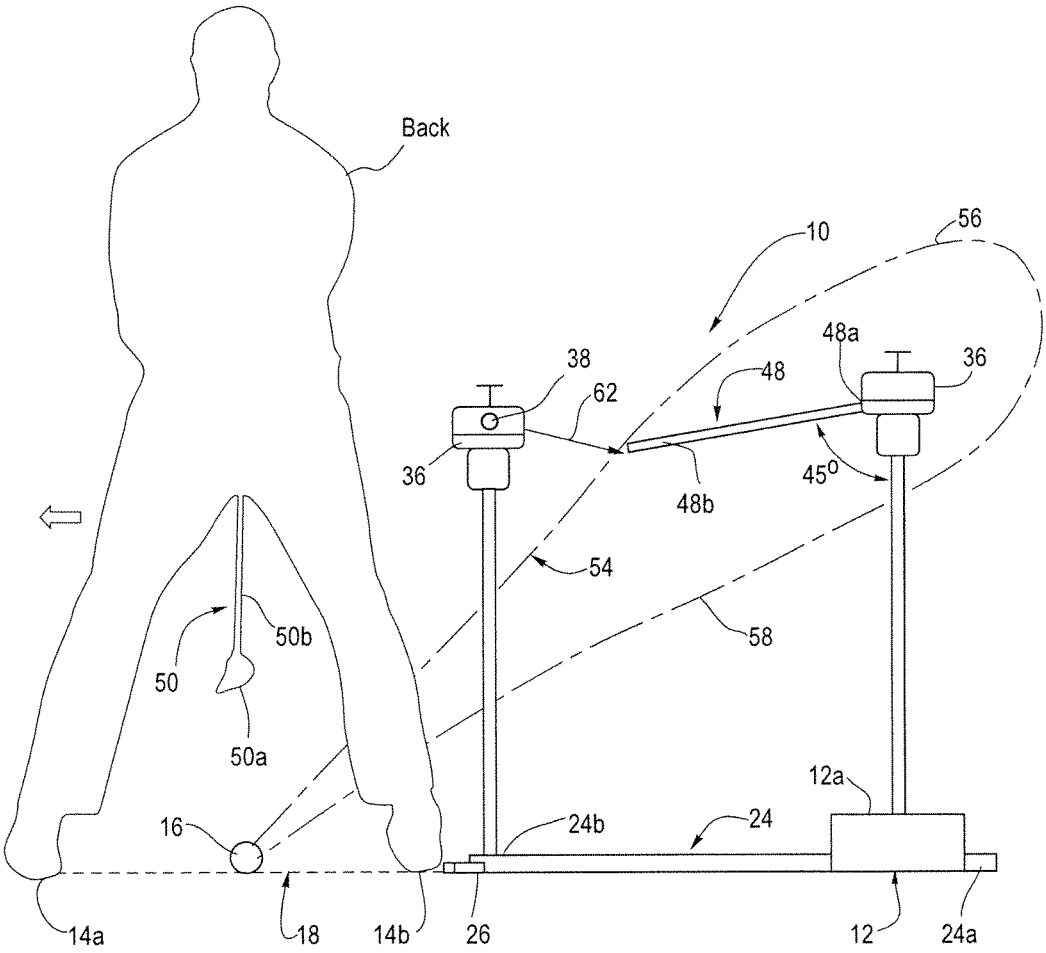
FIG. 4 is a side elevation view of the golf swing training device of the present invention from behind the golfer.

Referring to FIG. 1, there is shown a perspective view of the golf swing training device 10 of the present invention. FIG. 2 is a top plan view of the golf swing device 10 shown in FIG. 1. FIGS. 3 and 4 are side views of the golf swing training device 10.

Golf swing training device 10 includes a base 12 adapted for positioning on a flat surface such as the ground or a floor. Base 12 is preferably comprised of a piece of molded plastic having a rectangular cross section. Attached to a lateral portion of a first end portion 12*a* of base 12 is an alignment rod 18 which is also disposed on the ground, or a mat, and is in closely spaced relation to the feet 14*a* and 14*b* of the golfer using the golf swing training device 10. Alignment rod 18 is preferably comprised of a proximal portion 18*a* removable attached to base 12 and a distal portion 18*b*, where adjacent ends of the proximal and distal portions of the alignment rod are coupled together by a conventional coupling 20, which may be the hinged type. Alternatively, alignment rod 18 could be a telescoping type. This allows the alignment rod 18 to be extended to full length for use as shown in the figures, or shortened for travel or storage. Alternatively, the alignment rod could be a flexible rod or chord. The alignment rod may have markings to aide in positioning the feet 14*a*, 14*b* in relation to the ball 16. Alignment rod 18 is aligned with the intended direction of flight of a golf ball 16 positioned on an imaginary dotted line 17 which is generally perpendicular to the alignment rod and extends between, and approximately equally space from, the feet 14*a*, 14*b* of the golfer.

Attached to base 12 generally adjacent its first end portion 12*a* is a first elongated, linear support rod 44. Support rod 44 extends vertically upward from base 12 and has disposed on its upper end a spring-like resilient connector 46 preferably comprised of rubber or a flexible metal. Connector 46 can be adjustable and rotatable to alter the position of the downswing arm 48. Attached to connector 46 is an inclined downswing arm 48 having an inner elongated, semi-rigid linear rod 48*a* and an outer foam cover 48*b* disposed over the inner rod substantially along its entire length. Alternatively, the inclined downswing arm 48 could be comprised of a suitable material rigid enough to maintain its shape and position but flexible enough that contact with the downswing arm 48 will not damage a golf club. The spring-like connector 46 allows the downswing arm 48 to be contacted such as by a golf club in the hands of a golfer and deflected from its initial position, and to return to its initial position following removal of the deflecting force. Downswing arm 48 is preferably disposed at an angle of approximately 30° relative to the axial direction of the alignment rod 18 as shown in FIG. 2. Downswing arm 48 is adjustable and can be disposed at an angle between 0° and 40° relative to the axial direction of alignment rod 18. In addition, as shown in FIG. 1, the downswing arm 48 is inclined downward at an angle of approximately 45° from its proximal end coupled to spring-like connector 46 to its distal, free end as shown in FIG. 1. The incline angle of downswing atm 48 is also adjustable to accommodate different youth and adult golfers.

Attached to a second opposed end 12*b* of base 12 is a first backswing arm 24. The backswing arm 24 preferably may be a telescoping rod and the proximal end 24*a* of the backswing arm 24 is coupled to the second end portion 12*b* of base 12 by an adjustable device such as a bracket 22 which allows for variation in position and orientation of the arm. Use of a telescoping rod also allows for adjustments to accommodate a variety of youth and adult golfers. In this manner, the length of the backswing arm 24 and its relative position with respect to base 12 may be adjusted to accommodate golfers of various sizes. While a telescoping arm is preferred, other similar structural rods, shaft, beam, rope or the like may be used. Backswing arm 24 is also adapted for positioning on the ground as is base 12, and has attached to its distal end 24*b* a cross member 26, a connector 30, and a generally vertical second support rod 28. Attached to the upper end of the second vertical support rod 28 by a second spring-like connector 36 is a generally horizontal second backswing arm 38 also having a flexible, resilient elongated inner rod 38*a* and an outer foam cover 38*b* disposed over the inner rod along a substantial portion of its length. The second backswing arm 38 can be comprised of a suitable material rigid enough to maintain its shape and position, but flexible enough that contact with the second backswing arm 48 will not damage a golf club. Spring-like connector 36 permits the backswing arm 38 to pivot about the second support rod 28 when impacted by a golf club, while allowing the backswing arm to return to its initial undeflected position upon removal of the deflection force. In the following discussion, the ideal golf swing is shown in dotted line form in terms of three (3) components: the takeaway backswing 54, the downswing 58 and the curvilinear transition 56 in proceeding from the backswing to the downswing.

In using the golf swing training device 10, the golfer positions his or her feet 14*a* and 14*b* as shown in the figures. The golfer is then in facing relation to golf ball 16 which is located in line with a distal end portion of the horizontal backswing arm 38. With the golf club head positioned adjacent to, and just behind, the golf ball 16, the golfer initiates the takeaway and backswing shown in dotted-line form as element 54 which proceeds in the direction of arrow 60. During the backswing, the shaft of the golf club is drawn along the backswing path 54 and through the space defined by arrow 62 between the distal end of the horizontal backswing arm 38 and the distal end of the inclined downswing arm 48 as shown in the figures. During the initial portion of the backswing, or the takeaway, the head of the golf club 50 is displaced rearward and upward from a position immediately aft of the golf ball 16 so that the head 50*a* of golf club 50 passes just below the distal portion of the horizontal backswing arm 38 as shown in FIG. 1. As the golf club shaft 50*b* transits the gap 62 between the adjacent distal portions of the horizontal backswing arm 38 and the inclined downswing arm 48, contact of the golf club's shaft or head with either of these arms provides a visual and tactile indication to the golfer that the takeaway portion of the backswing 54 is improper and is in need of correction.

The initial portion of the backswing 54 is generally linear as the golf club transits the gap 62 between the adjacent distal portions of the horizontal backswing arm 38 and the inclined downswing arm 38 and becomes curvilinear upon further rearward displacement of the golf club so that the backswing 54 becomes aligned with the first backswing arm 24, as shown in FIG. 2, particularly as the golf club 50 transits the aft end portion of the first backswing arm. The direction of travel of the golf club then undergoes a reversal as the club passes through a curvilinear transition path 56 in the direction of arrow 62 and the downswing portion 58 of the swing is initiated. The club's downswing path 58 is in the direction of the third direction arrow 64. The downswing path 58 is generally linear and parallel with the inclined downswing arm 48. The downswing path 58 is also closely spaced from the inclined downswing arm 48, and disposed between, the inclined downswing arm 48 and the alignment rod 18. The downswing 58 continues in the direction of the downswing path 58 through the golf ball 16, with the golf club's head 50*a* striking the golf ball and propelling it generally in line with the downswing path 58. The angle of the golf club head 50*a* relative to the golf ball 16 causes a right-to-left spin to be induced in the golf ball 16 so that as the golf ball flies through the air, it is drawn from right to left as the golf ball is viewed along the downswing path 58.

In a preferred embodiment of the invention, the approximate lengths of some of the components are as follows: the alignment rod 18 is sixty (60) inches in length, the first and second vertical support rods 44, 28 are respectively thirty (30) and sixteen (16) inches, the inclined downswing arm 48 is thirty-six (36) inches in length, and the second horizontal backswing arm is eighteen (18) inches in length. The dimensions of these components can be adjusted to accommodate different adult and youth golfers.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. Apparatus for developing a proper golf club swing involving the takeaway, backswing and downswing comprising:

a base adaptable to be positioned on the ground;

an alignment mechanism coupled to said base and positioned in a direction of an intended golf ball flight, wherein the feet of a golfer using the apparatus are to be generally aligned with the alignment mechanism to assist in the takeaway portion of golf club swing;

a backswing apparatus coupled to said base having a vertical component and a backswing component positioned generally horizontal to the ground, the backswing component disposed in a facing relation to the golfer, wherein the backswing apparatus defines the limits of a predetermined path of a backswing of a golf club swing; and an inclined downswing apparatus coupled to said base having a vertical component and a downswing component wherein the downswing component includes an end forming a gap with an end of the backswing component, the gap being of sufficient width for a golf club head to travel, said inclined downswing apparatus being adjustably oriented at an angle relative to said alignment mechanism, wherein said inclined downswing apparatus is aligned to define the limits of a predetermined path of the downswing of the golf club swing.

2. The apparatus of claim 1, wherein said backswing component is oriented at an angle approximately 0° and 40° relative to said alignment mechanism.

3. The apparatus of claim 1, wherein the downswing component comprises a flexible material.

4. The apparatus of claim 3 further comprising a resilient coupler connecting the backswing component of the backswing apparatus to the vertical component allowing said backswing component to be deflected from an initial position upon impact with a golf club.

5. The apparatus of claim 4, wherein said downswing component comprises an elongated, flexible linear member extending substantially the length of the downswing component to absorb impact from a golf club.

6. The apparatus of claim 1, wherein said backswing component is aligned perpendicular to said alignment mechanism.

7. The apparatus of claim 6, wherein the vertical component of the backswing apparatus is flexibly coupled to the base.

8. The apparatus of claim 7, wherein the vertical component of the backswing apparatus further comprises a flexible coupling adjoining the backswing component to the vertical component.

9. The apparatus of claim 1, wherein the backswing component includes an elongated, flexible, linear member extending substantially the length of the backswing component to absorb impact from a golf club.

10. The apparatus of claim 1, wherein the alignment mechanism is retractable within the base.

11. The apparatus of claim 1, wherein the gap between the backswing component and the downswing component is approximately six (6) inches.

12. A portable apparatus for developing a proper golf swing including the takeaway, backswing and downswing comprising:

a base adapted to be positioned on a surface;

an alignment mechanism coupled to the base capable of being positioned on the surface to be generally aligned in the intended direction of the flight of a golf ball;

a backswing apparatus coupled to the base including a first backswing arm and a second backswing arm, wherein the second backswing arm is aligned in a manner to define an outer limit of an optimal path of travel of a golf club during a backswing of a golfer;

a downswing apparatus coupled to the base including a downswing arm oriented at an angle relative to the alignment mechanism aligned in a manner to define an outer limit of an optimal path of travel of a golf club during a downswing of the golfer;

wherein the second backswing arm and the downswing arm define a gap through which the golf club travels during the backswing such that the golf club passes above and travels along a portion of the length of the first backswing arm during the backswing.

13. The apparatus of claim 12, wherein the backswing arm and downswing arm each comprise an elongated member.

14. The apparatus of claim 12, wherein the backswing arm and downswing arm each comprising a flexible material.

15. The apparatus of claim 12, wherein the gap between the backswing arm and downswing arm causes the predetermined swing path to follow a generally linear path as the golf club transits the gap.

16. The apparatus of claim 15, wherein the backswing arm is positioned to cause the predetermined swing path of the golf club movement in the swing to become curvilinear upon rearward displacement of the club.

17. The apparatus of claim 16, wherein the downswing arm is positioned to cause the predetermined swing path of the golf club movement in the swing to follow the incline of the downswing arm.

18. The apparatus of claim 12, wherein the backswing arm is positioned to cause the predetermined swing path of the golf club movement during the backswing to become curvilinear upon rearward displacement of the club.

19. The apparatus of claim 12, wherein the downswing arm is positioned to cause the predetermined swing path of the golf club movement during the downswing to follow the downswing arm.

20. The apparatus of claim 19, wherein the backswing arm is positioned to cause the predetermined swing path of the golf club movement during the backswing to become curvilinear upon rearward displacement of the club.

* * * * *